United States Patent [19]

Shuttleworth et al.

[11] Patent Number: 4,914,077

[45] Date of Patent: Apr. 3, 1990

[54] ALKYL- OR ARYL-AMINO-PYRIDINYL- OR PYRIMIDINYL-AZO YELLOW DYE-DONOR ELEMENT FOR THERMAL DYE TRANSFER

[75] Inventors: Leslie Shuttleworth; Helmut Weber, both of Webster, N.Y.

[73] Assignee: Eastman Kodak Company, Rochester, N.Y.

[21] Appl. No.: 324,476

[22] Filed: Mar. 16, 1989

Related U.S. Application Data

[63] Continuation-in-part of Ser. No. 190,810, May 6, 1988, abandoned.

[51] Int. Cl.[4] ..... B41M 5/035; B41M 5/26

[52] U.S. Cl. ..... 503/227; 8/471; 428/195; 428/480; 428/913; 428/914

[58] Field of Search ..... 8/471; 428/195, 480, 428/913, 914; 503/227

[56] References Cited

U.S. PATENT DOCUMENTS 4,614,521 9/1986 Niwa et al. ..... 8/471

FOREIGN PATENT DOCUMENTS 2404854 8/1975 Fed. Rep. of Germany ..... 503/227

*Primary Examiner*—Bruce H. Hess

*Attorney, Agent, or Firm*—Harold E. Cole

[57] ABSTRACT

A yellow dye-donor element for thermal dye transfer comprising a plastic film support having thereon a yellow dye dispersed in a polymeric binder, the dye comprising an alkyl- or aryl-amino-pyridinyl- or pyrimidinyl-azo yellow dye which does not have any reactive pendant moiety capable of undergoing Michael-type addition.

In a preferred embodiment of the invention, the dye has the formula:

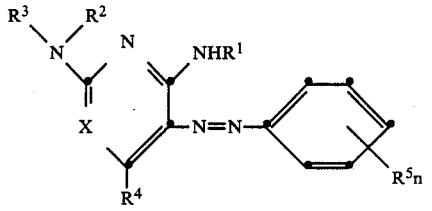

where $R^1$ and $R^2$ each independently represent a substituted or unsubstituted alkyl group having from 1 to about 10 carbon atoms; a cycloalkyl group having from about 5 to about 7 carbon atoms or an aryl group having from about 6 to about 10 carbon atoms;

$R^3$ represents hydrogen or $R^1$;

$R^4$ represents hydrogen or $R^1$;

$R^5$ represents halogen; cyano; nitro; a substituted or unsubstituted alkyl or alkoxy group having from 1 to about 10 carbon atoms; a cycloalkyl group having from about 5 to about 7 carbon atoms; a substituted or unsubstituted aryl or aryloxy group having from about 6 to about 10 carbon atoms; $COOR^1$; $CON(R^4)_2$; $NHCOR^1$; $NHSO_2R^1$; $SO_2R^1$; or $COR^1$;

X represents N or $CR^6$;

$R^6$ represents hydrogen, halogen, cyano, $CON(R^4)_2$, $COR^1$, $CO_2R^1$ or $R^1$; and n represents an integer from 0 to 5.

20 Claims, No Drawings

ALKYL- OR ARYL-AMINO-PYRIDINYL- OR PYRIMIDINYL-AZO YELLOW DYE-DONOR ELEMENT FOR THERMAL DYE TRANSFER

This application is a continuation-in-part of U.S. application Ser. No. 190,810, filed May 6, 1988, now abandoned.

This invention relates to dye-donor elements used in thermal dye transfer which have good hue and dye stability.

In recent years, thermal transfer systems have been developed to obtain prints from pictures which have been generated electronically from a color video camara. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The proess is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

A problem has existed with the use of certain dyes in dye-donor elements for thermal dye transfer printing. Many of the dyes proposed for use do not have adequate stability to light. Others do not have good hue. It would be desirable to provide dyes which have good light stability and have improved hues.

U.S. Pat. No. 4,614,521 relates to various sublimable dyes which are useful in thermal transfer systems. These dyes include azo dyes, such as bis-alkylamino-pyridinyl-azo dyes, as illustrated in columns 47 and 48 as compounds 3 and 5. Both of these compounds are red, however, having a λmax of 510 and 519. In addition, all of those azo dyes have a vinylsulfone group capable of undergoing Michael-type addition, which in turn requires that the receiving layer have a compound capable of reacting with this group. There is a problem in using dyes having a reactive moiety upon keeping. Such dyes would tend to react with hydroxyl groups which may be present in the binder, water or residual coating solvent, or the dye may even react with another dye molecule. This would lead to reductions in transferred dye density. It would be desirable to provide dyes which have good hue and which do not have a reactive moiety, and which do not require a receiving element having a reactive compound.

German OLS 2,404,854 relates to dyes similar to those described herein but which are used for textile printing. They are printed on transfer paper, however, and are not used in the same manner as the dyes described herein.

Substantial improvements in light stability and hues are achieved in accordance with this invention which comprises a yellow dye-donor element for thermal dye transfer comprising a plastic film support having thereon a yellow dye dispersed in a polymeric binder, the dye comprising an alkyl- or aryl-amino-pyridinyl- or pyrimidinyl-azo yellow dye which does not have any reactive pendant moiety capable of undergoing Michael-type addition.

The term "Michael addition" is well known to those skilled in the art. In general, a compound capable of undergoing Michael addition has a reactive polarized carbon-carbon double bond system which is known as a Michael-type acceptor. The polarized nature of such double bonds makes them susceptible to nucleophilic addition reactions with a variety of nucleophilic reagents including amines, hydroxyl-containing compounds and water. This term is described more fully in Jerry March, *Advanced Organic Chemistry; Reactions, Mechanism, and Structure,* 1968, McGraw-Hill, Inc., pages 567–590. As described above, the dye compounds employed in this invention do not have any such moieties on them.

In a preferred embodiment of the invention, the dye has the formula:

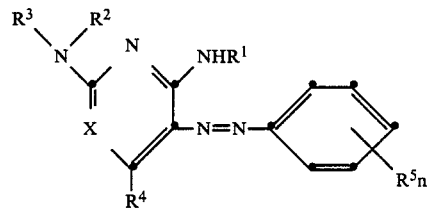

wherein $R^1$ and $R^2$ each independently represent a substituted or unsubstituted alkyl group having from 1 to about 10 carbon atoms, such as methyl, ethyl, propyl, isopropyl, butyl, pentyl, hexyl, methoxyethyl, benzyl, 2-methanesulfonamidoethyl, 2-hydroxyethyl, 2-cyanoethyl, methoxycarbonylmethyl, etc.; a cycloalkyl group having from about 5 to about 7 carbon atoms, such as cyclohexyl, cyclopentyl, etc.; or an aryl group having from about 6 to about 10 carbon atoms, such as phenyl, pyridyl, naphthyl, p-tolyl, p-chlorophenyl, or m-(N-methyl sulfamoyl)phenyl;

$R^3$ represents hydrogen or $R^1$;

$R^4$ represents hydrogen or $R^1$;

$R^5$ represents halogen; cyano; nitro; a substituted or unsubstituted alkyl or alkoxy group having from 1 to about 10 carbon atoms, such as methyl, ethyl, propyl, isopropyl, butyl, pentyl, hexyl, trifluoromethyl, perfluoroethyl, perfluorohexyl, methoxyethyl, benzyl, 2-methanesulfonamidoethyl, 2-hydroxyethyl, 2-cyanoethyl, methoxycarbonylmethyl, methoxy, ethoxy, methoxyethoxy 2-cyanoethoxy etc.; a cycloalkyl group having from about 5 to about 7 carbon atoms, such as cyclohexyl, cyclopentyl, etc.; a substituted or unsubstituted aryl or aryloxy group having from about 6 to about 10 carbon atoms, such as phenyl, pyridyl, naphthyl, p-tolyl, p-chlorophenyl, m-(N-methyl sulfamoyl)-phenyl, m-chlorophenoxy, p-fluorophenyl, 3-pyridyl or 1-naphthyl; $COOR^1$ such as $CO_2CH_3$ or $CO_2C_3H_7$; $CON(R^4)_2$ such as $CONHCH_3$, $CONHC_2H_5$ or $CON(C_2H_5)_2$; $NHCOR^1$ such as $NHCOC_6H_5$ or $NHCOCH_3$; $NHSO_2R^1$ such as $NHSO_2C_2H_5$ or $NHSO_2C_6H_5$; $SO_2R^1$ such as $SO_2(p\text{-}ClC_6H_4)$; or $COR^1$ such as $COCH_3$ or $COC_3H_7$;

X represents N or $CR^6$;

$R^6$ represents hydrogen; halogen, such as chlorine, bromine, or fluorine; cyano; $CON(R^4)_2$, $COR^1$, $CO_2R^1$ or $R^1$; and n represents an integer from 0 to 5.

In a preferred embodiment of the invention, $R^1$ and $R^2$ in the above formula are each independently butyl, cyclohexyl, $CH_3OC_2H_4$— or $CH_3OCH_2(CH_3)CH$— and $R^3$ is hydrogen. In another preferred embodiment, X is $CR^6$ wherein $R^6$ is cyano. In still another preferred embodiment, X is N. In yet still another preferred embodiment, $R^4$ is methyl or phenyl. In yet still another preferred embodiment, $R^5$ is chloro, cyano, nitro, methoxy, $CF_3$, $CO_2C_2H_5$, $CON(C_2H_5)_2$, $CO_2C(CH_3)_3$, $CO_2CH_2C(CH_3)_3$ or $CO_2C_2H_4CH(CH_3)_2$ and n is 1 or 2.

The dyes in this invention may be prepared by the methods described in German OLS 2,404,854 and 2,715,984 and British 1,569,937.

Compounds included within the scope of the invention include the following:

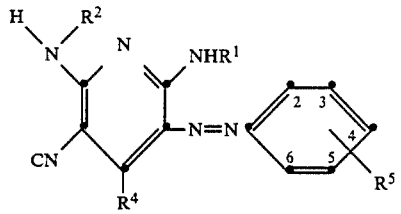

| Cmpd. | $R^1$ | $R^2$ | $R^4$ | $R^5$ |
|---|---|---|---|---|
| 1 | $CH_3OC_2H_4$— | $CH_3OC_2H_4$— | $CH_3$ | 4-Cl |
| 2 | $CH_3OC_2H_4$— | $CH_3OC_2H_4$— | $CH_3$ | 4-$CO_2C_2H_5$ |
| 3 | $CH_3OC_2H_4$— | $CH_3OC_2H_4$— | $CH_3$ | 3-$CO_2C_2H_5$ |
| 4 | $CH_3OC_2H_4$— | $CH_3OC_2H_4$— | $CH_3$ | 2,5,-($OCH_3$) |
| 5 | n-$C_4H_9$— | $CH_3OC_2H_4$— | $CH_3$ | 2-$OCH_3$ |
| 6 | $CH_3OC_2H_4$— | n-$C_4H_9$— | $CH_3$ | 2-$OCH_3$ |
| 7 | n-$C_4H_9$— | n-$C_4H_9$— | $CH_3$ | 2-$CF_3$ |
| 8 | n-$C_4H_9$— | n-$C_4H_9$— | $CH_3$ | 2-$CO_2C_2H_5$ |
| 9 | 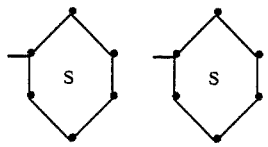 | | $CH_3$ | 2-$CF_3$ |
| 10 | $CH_3OC_2H_4$— | $CH_3OC_2H_4$— | $CH_3$ | 2-$CO_2C_2H_5$ |
| 11 | n-$C_4H_9$— | n-$C_4H_9$— | $C_6H_5$ | 2-$CF_3$ |
| 12 | n-$C_4H_9$— | n-$C_4H_9$— | $C_6H_5$ | 2-$CO_2C_2H_5$ |
| 13 | n-$C_4H_9$— | n-$C_4H_9$— | $C_6H_5$ | 2-CN |
| 14 | $CH_3OC_2H_4$— | $CH_3OC_2H_4$— | $CH_3$ | 2-$CON(C_2H_5)_2$ |
| 15 | $CH_3OC_2H_4$— | $CH_3OC_2H_4$— | $CH_3$ | 2-$CO_2C(CH_3)_2$ |
| 16 | $CH_3OC_2H_4$— | $CH_3OC_2H_4$— | $CH_3$ | 2-$CO_2CH_2C(CH_3)_2$ |
| 17 | $CH_3OC_2H_4$— | $CH_3OC_2H_4$— | $CH_3$ | 2-$CO_2C_2H_4CH(CH_3)_2$ |
| 18 | n-$C_4H_9$— | n-$C_4H_9$— | $CH_3$ | 2-CN |

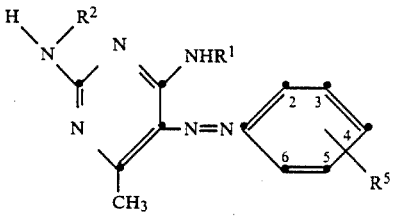

| Cmpd. | $R^1$ | $R^2$ | $R^5$ |
|---|---|---|---|
| 19 | n-$C_4H_9$— | n-$C_4H_9$— | 2-CN |
| 20 | n-$C_4H_9$— | n-$C_4H_9$— | 2-$CF_3$ |
| 21 | n-$C_4H_9$— | n-$C_4H_9$— | 4-$NO_2$ |
| 22 | $CH_3OCH_2(CH_3)CH$— | $CH_3OCH_2(CH_3)CH$— | 2-CN |
| 23 | $CH_3OC_2H_4$— | $CH_3OC_2H_4$— | 2-$CF_3$ |

A dye-barrier layer may be employed in the dye-donor elements of the invention to improve the density of the transferred dye. Such dye-barrier layer materials include hydrophilic materials such as those described and claimed in U.S. Pat. No. 4,716,144 by Vanier, Lum and Bowman.

The dye in the dye-donor element of the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207 of Vanier and Lum; a polycarbonate; poly(styrene-co-acrylonitrile), a poly(sulfone) or a poly(phenylene oxide). The binder may be used at a coverage of from about 0.1 to about 5 $g/m^2$.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyetherimides. The support generally has a thickness of from about 2 to about 30 μm. It may also be coated with a subbing layer, if desired, such as those materials described in U.S. Pat. Nos. 4,695,288 or 4,737,416.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), silicone oil, poly(tetrafluoroethylene), carbowax, poly(ethylene glycols), or any of those materials disclosed in U.S. Pat. Nos. 4,717,711, 4,717,712, 4,737,485 or 4,738,950. Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 $g/m^2$. If a polymeric binder is employed, the lubricating material is present in the range of 0.1 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as duPont Tyvek®.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 $g/m^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only the dye thereon as described above or may have alternating areas of other different dyes, such as sublimable cyan and/or magenta and/or yellow and/or black or other dyes. Such dyes are disclosed in U.S. Pat. Nos. 4,541,830, 4,698,651, 4,695,287, 4,701,439, 4,757,046, 4,743,582, 4,769,360 or 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of magenta, cyan and a dye as described above of yellow hue, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following example is provided to illustrate the invention.

EXAMPLE 1

Yellow Dye-Donor

A yellow dye-donor element was prepared by coating the following layers in the order recited on a 6 μm poly(ethylene terephthalate) support:

(1) Dye-barrier layer of poly(acrylic) acid (0.16 $g/m^2$) coated from water, and (2) Dye layer containing the yellow dye identified in Table 1 below (0.63 $mmoles/m^2$), FC-431® surfactant (3M Corp.) (0.002 $g/m^2$), in a cellulose acetate (40% acetyl) binder (weight equal to 1.2X that of the dye) coated from a cyclohexanone and 2-butanone solvent mixture.

A subbing and slipping layer were coated on the back side of the element similar to those disclosed in EPA 295,483.

A dye-receiving element was prepared by coating a solution of Makrolon 5705 ® (Bayer AG Corporation) polycarbonate resin (2.9 g/m$^2$ in a methylene chloride and trichloroethylene solvent mixture on an ICI Melinex 990 ® white polyester support.

The dye side of the dye-donor element strip approximately 19 mm wide was placed in contact with the dye image-receiving layer of the dye-receiver element of the same width. The assemblage was fastened in the jaws of a stepper motor driven pulling device. The assemblage was laid on top of a 0.55 (14 mm) diameter rubber roller and a TDK Thermal Head (No. L-133) and was pressed with a spring at a force of 8.0 pounds (3.6 kg) against the dye-donor element side of the assemblage pushing it against the rubber roller.

The imaging electronics were activated causing the pulling device to draw the assemblage between the printing head and roller at 3.1 mm/sec. Coincidentally, the resistive elements in the thermal print head were pulse-heated at increments from 0 up to 8 msec to generate a graduated-density image. The voltage supplied to the print head was approximately 22 v representing approximately 1.5 watts/dot (12 mjoules/dot) for maximum power.

The dye-receiving element was separated from the dye-donor element and the Status A blue reflection density at the maximum density was read. The images were then subjected to High-Intensity Daylight fading (HID-fading) for 7 days, 50 kLux, 5400° K., 32° C., approximately 25% RH and the densities were reread. The percent density loss was calculated from D-max. The λ-max of each dye was also measured in an acetone solution. The following results were obtained:

TABLE 1

| Dye Donor Element w/ Compound | λ max (nm) | Status A Blue Density D max | Status A Blue Density % Loss After Fade |
|---|---|---|---|
| 1 | 431 | 2.1 | 17 |
| 2 | 425 | 1.9 | 20 |
| 3 | 448 | 2.2 | 14 |
| 4 | 453 | 1.8 | 24 |
| 5 | 435 | 1.7 | 14 |
| 6 | 425 | 1.7 | 12 |
| 7 | 440 | 2.3 | 4 |
| 8 | 439 | 1.9 | 4 |
| 9 | 439 | 1.0 | 10 |
| 10 | 432 | 2.0 | 6 |
| 11 | 434 | 1.0 | 17 |
| 12 | 438 | 1.0 | 25 |
| 13 | 452 | 1.4 | 9 |
| 14 | 418 | 1.4 | 8 |
| 15 | 432 | 1.5 | 13 |
| 16 | 433 | 1.4 | 13 |
| 17 | 433 | 1.4 | 11 |
| 18 | 456 | 0.8 | 5 |
| 19 | 415 | 1.9 | 12 |
| 20 | 405 | 1.5 | 12 |
| 21 | 449 | 2.0 | 11 |
| 22 | 412 | 1.7 | 8 |
| 23 | 401 | 0.9 | 9 |

The above results indicate that the dyes according to the invention have significantly improved λ-max (closer to 450 nm) than the closely-related dyes of U.S. Pat. No. 4,614,521 which have a λ-max of 510 and 519 nm (columns 47 and 48). The dyes of the invention are thus better yellow dyes. In addition, the dyes of the invention also have very good stability to light upon fading.

The invention has been described in detail with particular reference to preferred embodiments thereof, but it will be understood that variations and modifications can be effected within the spirit and scope of the invention.

What is claimed is:

1. A yellow dye-donor element for thermal dye transfer comprising a plastic film support having thereon a yellow dye dispersed in a polymeric binder, said dye comprising a 3-arylazo-2,6-di-alkyl- or aryl-amino-pyridine or 5-arylazo-2,6-di-alkyl- or aryl-amino-pyrimidine yellow dye, said dye not having any reactive pendant moiety capable of undergoing Michael-type addition.

2. The element of claim 1 wherein said dye has the formula:

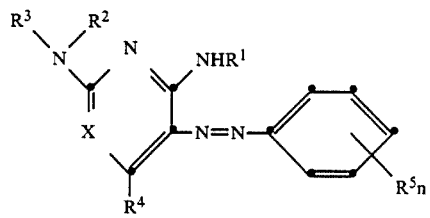

wherein $R^1$ and $R^2$ each independently represent a substituted or unsubstituted alkyl group having from 1 to about 10 carbon atoms; a cycloalkyl group having from about 5 to about 7 carbon atoms or an aryl group having from about 6 to about 10 carbon atoms;

$R^3$ represents hydrogen or $R^1$;

$R^4$ represents hydrogen or $R^1$;

$R^5$ represents halogen; cyano; nitro; a substituted or unsubstituted alkyl or alkoxy group having from 1 to about 10 carbon atoms; a cycloalkyl group having from about 5 to about 7 carbon atoms; a substituted or unsubstituted aryl or aryloxy group having from about 6 to about 10 carbon atoms; $COOR^1$; $CON(R^4)_2$; $NHCOR^1$; $NHSO_2R^1$; $SO_2R^1$; or $COR^1$;

X represents N or $CR^6$;

$X^6$ represents hydrogen, halogen, cyano, $CON(R^4)_2$, $COR^1$, $CO_2R^1$ or $R^1$; and n represents an integer from 0 to 5.

3. The element of claim 2 wherein $R^1$ and $R^2$ are each independently butyl, cyclohexyl, $CH_3OC_2H_4$— or $CH_3OCH_2(CH_3)CH$— and $R^3$ is hydrogen.

4. The element of claim 2 wherein X is $CR^6$ wherein $R^6$ is cyano.

5. The element of claim 2 wherein X is N.

6. The element of claim 2 wherein $R^4$ is methyl or phenyl.

7. The element of claim 2 wherein $R^5$ is chloro, cyano, nitro, methoxy, $CF_3$, $CO_2C_2H_5$, $CON(C_2H_5)$, $CO_2C(CH_3)_3$, $CO_2CH_2C(CH_3)_3$ or $CO_2C_2H_4CH(CH_3)_2$ and n is 1 or 2.

8. The element of claim 1 wherein said support comprises poly(ethylene terephthalate) and the side of the support opposite the side having thereon said dye layer is coated with a slipping layer comprising a lubricating material.

9. The element of claim 1 wherein said dye layer comprises sequential repeating areas of magenta, cyan and said yellow dye.

10. In a process of forming a dye transfer image comprising imagewise-heating a dye-donor element comprising a plastic film support having thereon a dye layer comprising a yellow dye dispersed in a polymeric binder and transferring a dye image to a dye-receiving element to form said dye transfer image, the improvement wherein said dye comprises a 3-arylazo-2,6-di-alkyl- or aryl-amino-pyridine or 5-arylazo-2,6-di-alkyl- or aryl-amino-pyrimidine yellow dye, said dye not having any reactive pendant moiety capable of undergoing Michael-type addition.

11. The process of claim 10 wherein said dye has the formula:

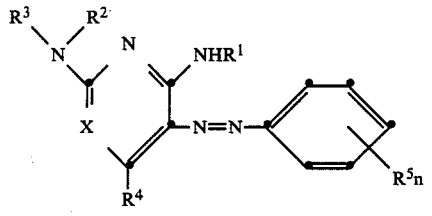

wherein $R^1$ and $R^2$ each independently represent a substituted or unsubstituted alkyl group having from 1 to about 10 carbon atoms; a cycloalkyl group having from about 5 to about 7 carbon atoms or an aryl group having from about 6 to about 10 carbon atoms;

$R^3$ represents hydrogen or $R^1$;

$R^4$ represents hydrogen or $R^1$;

$R^5$ represents halogen; cyano; nitro; a substituted or unsubstituted alkyl or alkoxy group having from 1 to about 10 carbon atoms; a cycloalkyl group having from about 5 to about 7 carbon atoms; a substituted or unsubstituted aryl or aryloxy group having from about 6 to about 10 carbon atoms; $COOR^1$; $CON(R^4)_2$; $NHCOR^1$; $NHSO_2R^1$; $SO_2R^1$; or $COR^1$;

X represents N or $CR^6$;

$R^6$ represents hydrogen, halogen, cyano, $CON(R^4)_2$, $COR^1$, $CO_2R^1$ or $R^1$; and n represents an integer from 0 to 5.

12. The process of claim 11 wherein said support is poly(ethylene terephthalate) which is coated with sequential repeating areas of magenta, cyan and said yellow dye, and said process steps are sequentially performed for each color to obtain a three-color dye transfer image.

13. In a thermal dye transfer assemblage comprising:

(a) a dye-donor element comprising a plastic film support having thereon a dye layer comprising a yellow dye dispersed in a polymeric binder, and (b) a dye-receiving element comprising a support having thereon a dye image-receiving layer, said dye-receiving element being in a superposed relationship with said dye-donor element so that said dye layer is in contact with said dye image-receiving layer, the improvement wherein said dye comprises a 3-arylazo-2,6-di-alkyl- or aryl-amino-pyridine or 5-arylazo-2,6-di-alkyl- or aryl-amino-pyrimidine yellow dye, said dye not having any reactive pendant moiety capable of undergoing Michael-type addition.

14. The assemblage of claim 13 wherein said dye has the formula:

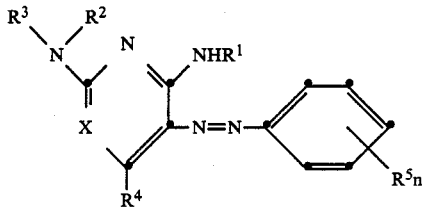

wherein $R^1$ and $R^2$ each independently represent a substituted or unsubstituted alkyl group having from 1 to about 10 carbon atoms; a cycloalkyl group having from about 5 to about 7 carbon atoms or an aryl group having from about 6 to about 10 carbon atoms;

$R^3$ represents hydrogen or $R^1$;

$R^4$ represents hydrogen or $R^1$;

$R^5$ represents halogen; cyano; nitro; a substituted or unsubstituted alkyl or alkoxy group having from 1 to about 10 carbon atoms; a cycloalkyl group having from about 5 to about 7 carbon atoms; a substituted or unsubstituted aryl or aryloxy group having from about 6 to about 10 carbon atoms; $COOR^1$; $CON(R^4)_2$; $NHCOR^1$; $NHSO_2R^1$; $SO_2R^1$; or $COR^1$;

X represents N or $CR^6$;

$R^6$ represents hydrogen, halogen, cyano, $CON(R^4)_2$, $COR^1$, $CO_2R^1$ or $R^1$; and n represents an integer from 0 to 5.

15. The assemblage of claim 14 wherein $R^1$ and $R^2$ are each independently butyl, cyclohexyl, $CH_3OC_2H_4$— or $CH_3OCH_2(CH_3)CH$— and $R^3$ is hydrogen.

16. The assemblage of claim 14 wherein X is $CR^6$ wherein $R^6$ is cyano.

17. The assemblage of claim 14 wherein X is N.

18. The assemblage of claim 14 wherein $R^4$ is methyl or phenyl.

19. The assemblage of claim 14 wherein $R^5$ is chloro, cyano, nitro, methoxy, $CF_3$, $CO_2C_2H_5$, $CON(C_2H_5)_2$, $CO_2C(CH_3)_3$, $CO_2CH_2C(CH_3)_3$ or $CO_2C_2H_4CH(CH_3)_2$ and n is 1 or 2.

20. The assemblage of claim 14 wherein the support of said dye-donor comprises poly(ethylene terephthalate) and the side of the support opposite the side having thereon said dye layer is coated with a slipping layer comprising a lubricating material.

* * * * *